US005466917A

United States Patent [19]

Matsuki et al.

[11] Patent Number: 5,466,917

[45] Date of Patent: Nov. 14, 1995

[54] MICROWAVE-ABSORPTIVE HEAT-GENERATING BODY AND METHOD FOR FORMING A HEAT-GENERATING LAYER IN A MICROWAVE-ABSORPTIVE HEAT-GENERATING BODY

[75] Inventors: Masaharu Matsuki; Toshiaki Yoshihara; Sumihiko Kurita, all of Saga, Japan

[73] Assignee: Kabushiki Kaisha Kouransha, Saga, Japan

[21] Appl. No.: 965,286

[22] PCT Filed: Jun. 4, 1992

[86] PCT No.: PCT/JP92/00723

§ 371 Date: Feb. 25, 1993

§ 102(e) Date: Feb. 25, 1993

[87] PCT Pub. No.: WO92/22179

PCT Pub. Date: Dec. 10, 1992

[30] Foreign Application Priority Data

Jun. 5, 1991 [JP] Japan ..... 051045 U
Jan. 21, 1992 [JP] Japan ..... 4-006677 U

[51] Int. Cl.[6] ..... H05B 6/80

[52] U.S. Cl. ..... 219/730; 219/759; 99/DIG. 14; 426/103; 426/234; 426/243; 427/249; 428/285

[58] Field of Search ..... 219/759, 730, 219/10.55 M, 10.55 F; 99/DIG. 14; 426/103, 113, 234, 243; 428/308.8, 257, 285, 408; 427/249, 34, 226, 380; 164/14, 41, 46, 72

[56] References Cited

U.S. PATENT DOCUMENTS

| | | | |
|---|---|---|---|
| 3,683,996 | 8/1972 | Dunlop | 164/14 |
| 3,944,683 | 3/1976 | Church et al. | 427/450 |
| 4,518,651 | 5/1985 | Wolfe | 428/308.8 |
| 4,684,567 | 8/1987 | Okamoto et al. | 428/257 |
| 5,227,196 | 7/1993 | Itoh | 427/249 |
| 5,254,821 | 10/1993 | Walters | 219/730 |
| 5,260,125 | 11/1993 | Copes | 428/285 |

*Primary Examiner*—Tu Hoang
*Attorney, Agent, or Firm*—Nikaido Marmelstein Murray & Oram

[57] ABSTRACT

A sheet-like heat generation body for use in a microwave oven, which absorbs microwave and generates heat to irradiate food to be cooked. This heat generation body comprises a conductive film, which is made of a crystalline carbon as its principal component, and is formed on a sheet-like base material. The heat-generating body is prepared using a heat-resistant base material and an inorganic bonding agent applied to its surface. Specifically, a heat-resistant base is coated with a mixture of a microwave-absorbing and heat-generating material as its principal component and an agent for hardening an inorganic bonding agent to be applied later. After the mixed agent is dried, it is impregnated with the inorganic bonding agent.

18 Claims, 3 Drawing Sheets

MICROWAVE-ABSORPTIVE HEAT-GENERATING BODY AND METHOD FOR FORMING A HEAT-GENERATING LAYER IN A MICROWAVE-ABSORPTIVE HEAT-GENERATING BODY

TECHNICAL FIELD

The present invention relates to a microwave-absorptive heat-generating body which generates heat by absorbing energy of a microwave in an electronic oven.

The present invention also relates to a method for forming a heat-generating layer in such microwave-absorptive heat-generating body.

BACKGROUND ART

An electronic oven is a device in which cooking is effected by making use of the nature that an irradiated microwave is absorbed by molecules of water or the like contained in an article to be cooked, and it has a merit that generally cooking can be achieved in a short period of time. On the other hand, it cannot scorch food surfaces as is the case with external heating as by an oven, a gas range, an electric heater or the like.

In order to overcome the above-mentioned shortcoming, a heat-generating body or a heat-generating container capable of scorching foods by making use of substance which generates heat by absorbing a microwave such as ferrite, SiC, metal, barium titanate, etc., has been devised, and a sintered body of ferrite, silicon carbide or the like, a pottery having the sintered body assembled therein, and furthermore, a body formed by applying powder of these materials to a base material as a coating film, have been devised.

However, these heat-generating bodies involve many problems such that its heat-generating property is insufficient, they cannot withstand thermal shocks caused by abrupt heat-generation, and they are expensive and heavy in weight.

On the other hand, while a heat-generating sheet formed by applying metal vapor deposition of aluminium or the like onto a heat-resisting paper sheet, a heat-resisting resin film or the like has been devised, it has a shortcoming that a stable heat-generating quantity can be hardly assured because of the fact that it is necessary to make the thickness of vapor deposition considerably thin. It is hard to uniformly control the thickness due to its thin film state, and its heat-generating property would largely vary in the event that the thickness of the vapor deposition film should change.

A microwave-absorptive heat-generating body is formed of substances having a heat-resisting property in view of its function. A principal method for manufacture thereof includes a method of forming a conductive thin film of Al, $SnO_2$, etc. on a surface of a heat-resisting base material through vapor-deposition; a method of obtaining the heat-generating body by sintering powder having a microwave-absorptive heat-generating property such as ferrite, SiC, $BaTiO_3$, etc.; and a method of fixedly securing powder having a microwave-absorptive heat-generating property onto a surface of a heat-resisting base material by means of a heat-resisting organic bonding agent.

However, the above-mentioned heat-generating bodies produced through vapor deposition and/or sintering necessitate a high temperature at the time of manufacture and also result in a high cost in view of installation or the like. Also, the method of fixedly securing material having a microwave-absorptive heat-generating property by means of an organic bonding agent is limited with respect to its heat-resisting temperature.

In addition, although a method of fixedly securing the material by heating an inorganic bonding agent or adding a hardening agent to the inorganic bonding agent can be conceived in order to resolve the above-mentioned problems, even in such method, in the case of necessitating to heat, rise of energy and installation costs result, while in the case of adding a hardening agent, degradation of the working efficiency caused by decrease in the available time result. In either case, neither method is suitable to the case where mass-production is required.

The present invention has been worked out in view of the above-mentioned point, and one object of the present invention is to provide a sheet-like microwave-absorptive heat-generating body which is light in weight, flexible, excellent in a heat-generating property, and moreover, cheap.

Another object of the present invention is to provide a method for forming a microwave-absorptive heat-generating layer on a heat-resisting base material by making use of an inorganic bonding agent at a low temperature, and moreover, under a sufficient available time.

DISCLOSURE OF INVENTION

According to the present invention, the above-mentioned former object can be achieved by the microwave-absorptive heat-generating bodies disclosed in the following:

(1) A microwave-absorptive heat-generating body, characterized in that a conductive coating film containing crystalline carbon as its principal component is formed on a sheet-like base material.

(2) A heat-generating body as disclosed in paragraph (1) above, characterized in that the content in volume of crystalline carbon in the above-described conductive coating film is 15% or more.

(3) A heat-generating body as disclosed in paragraph (1) or (2) above, characterized in that a microwave-permeable inorganic coating film layer is laminated between the above-mentioned coating film layer and sheet-like base material or on the upper surface of the above-mentioned coating film layer.

(4) A heat-generating body as disclosed in paragraph (1), (2) or (3) above, characterized in that the thickness of the above-mentioned coating film is 5 μm~400 μm.

(5) A heat-generating body as disclosed in paragraph (1), (2), (3) or (4) above, characterized in that the above-mentioned coating film is formed in an array of divided small-area regions not continuous to one another, and the area of the continuous region is 5×5~60×60 $mm^2$.

(6) A heat-generating body as disclosed in paragraph (5) above, characterized in that areas of the divided regions of the above-mentioned coating film are varied depending upon its location on the sheet-like base material.

The above-described heat-generating bodies would generate heat and would reach a high temperature through the process that the conductive coating film containing carbon as its principal component and coated on the sheet-like base material absorbs a microwave radiated from a microwave range, and external heating for scorching foods would be effected by conduction heat and radiation heat from such heat-generating bodies.

The sheet-like base material to be applied with the above-described conductive coating film is a material capable of withstanding a high temperature (200°~400° C.) at the time of heat-generation, and so long as it is a microwave-permeable material, flame-resistant paper sheets, heat-resistant resin films, inorganic fiber paper sheets, etc. can be used widely, but in the case where the sheet reaches a considerably high temperature, a sheet made exclusively of inorganic material is desirable because if an organic component is contained in the sheet base material there is a risk of generating a harmful gas, smoke and a nasty smell. Especially, glass fabrics are relatively cheap and also have a flexibility, and hence they are practically useful.

The above-described conductive coating film is principally formed of crystalline carbon, and it can be easily formed by coating a paint prepared by mixing carbon powder or carbon fibers with an inorganic binder.

With regard to a method for coating, various methods such as screen printing, letterpress printing, offset printing, etc. can be chosen, and the method is not limited to a particular method.

While carbon has been heretofore well known as a heat-generating substance, carbon used according to the present invention is what is generally called graphite, which is a laminated body composed of a parallel stack of networks each consisting of a large number of carbon atoms connected two-dimensionally in a regular hexagonal ring shape, and which is characterized in that it is crystalline carbon which is regularly laminated has excellent heat-resisting property, and is hardly oxidized. In the so-called amorphous carbon such as carbon black, vitreous carbon or the like having a random layer structure in which there is no regularity in lamination, there exists a problem that it lacks a heat-resistant property and at the time of heat-generation it reacts with oxygen and results in smoke generation or deterioration of properties, and so, it is not suitable as a heat-generating substance. Also it has been heretofore known as a well-known fact that a good property can be obtained by forming a heat-generating body so that a surface resistance value of the heat-generating body may become $10^2$~$10^5$ Ω, and in the present invention also, a good property can be revealed provided that the surface resistance value falls in this range.

Between a resistance value and a specific resistance and a film thickness is established the following relation:

[Resistance value]=[Specific resistance]/[Film thickness]

The specific resistance of the coating film is different depending upon the blending proportion of carbon in the paint to be coated, and to components other than carbon such as an inorganic filler, a binder and the like. If the percentage in volume of contained carbon is increased, the specific resistance of the coating film will become small, but on the contrary, if the percentage by volume, of contained carbon is decreased, the specific resistance of the film will become large.

In order to obtain a desired resistance value, adjustment could be done to realize a film thickness matched with the specific resistance of the coating film, and the range of this adjustment is about 5 μm~1,000 μm. Since the coating film has a shortcoming in that if the thickness of the coating film is increased, the flexibility of the entire sheet is lost and the inorganic coating film becomes fragile, it is desirable to make the percentage in volume of contained carbon in the coating film to be 15% or more and to make the film thickness to be 5 μm~400 μm in view of the risk of damage during its handling. With regard to fillers other than carbon, provided that they are inorganic powder such as $SiO_2$, $Al_2O_3$, etc., they are not specifically limited to particular ones. Furthermore, for the purpose of making the sheet have flexibility, the above-described coating film could be formed in an array of divided small-area regions not continuous to one another rather than being coated over the entire surface of the sheet. In this modified case, not merely it can be achieved to make the sheet have the flexibility, but also a heat-generating quantity can be easily controlled so as to match the kind and amount of foods by decreasing a continuous area of a coating film in the case of suppressing its heat-generating property and, on the contrary, increasing it in the case of enhancing its heat-generating quantity, paying attention to the fact that the heat-generating property and a continuous area of a coating film are proportional to each other and as the area of the divided regions of the sheet becomes larger its heat-generating property (absorbing efficiency) is improved.

Though the area of the divided regions is required to be 5×5 $mm^2$ or more, because if the continuous area of the coating film is too small, its heat-generating quantity is so small that there is no effect, if it exceeds 60×60 $mm^2$, the flexibility of the sheet is deteriorated, and so, the scope of 5×5~60×60 $mm^2$ is most suitable.

In addition, by applying a microwave-permeable inorganic coating film between the above-described sheet base material and the conductive coating layer as an intermediate layer, the sheet is made to have a heat-insulating effect, and thereby it is made possible to safely use it even if the base material somewhat lacking a heat-resistant property.

Furthermore, although the conductive coating film principally consisting of crystalline carbon lacks a beautiful appearance, gives visually somewhat non-hygienic feeling as a body for use with foods and lacks excellence in design because of its black color, its excellence in design can be enhanced without degrading its properties by applying a microwave-permeable inorganic coating film added with an inorganic pigment and the like onto the conductive coating film.

The above-mentioned inorganic coating film could be made of $SiO_2$, $Al_2O_3$, clay, glass, etc. and it is not specifically limited to particular materials.

The above-described latter object of the present invention can be achieved by the methods disclosed in the following:

(1) A method for forming a microwave-absorptive heat-generating layer, characterized in that at the time of forming a microwave-absoptive heat-generating layer on a surface of a heat-resistant base material by making use of an inorganic bonding agent, after a mixture containing a microwave-absorptive heat-generating substance as its principal component and further containing at least one kind of hardening agent for the aforementioned bonding agent has been applied onto the above-mentioned base material, the above-described bonding agent is impregnated in the aforementioned applied film and hardened.

(2) A method for forming a microwave-absorptive heat-generating layer as disclosed in paragraph (1) above, characterized in that the aforementioned mixture contains $Fe_3O_4$ as its principal component, and further the above-mentioned inorganic bonding agent is a phosphate group bonding agent.

(3) A method for forming a microwave-absorptive heat-generating layer as disclosed in paragraph (1) above, characterized in that the aforementioned mixture contains crystalline carbon as its principal component, and further the aforementioned inorganic bonding agent is a phosphate group bonding agent.

(4) A method for forming a microwave-absorptive heat-generating layer as disclosed in paragraph (1) above, characterized in that the aforementioned mixture contains crystalline carbon, $Fe_3O_4$ and alumina sol, and further the aforementioned inorganic bonding agent is a phosphate group bonding agent.

At the time of forming a microwave-absorptive heat-generating layer according to the present invention, while the preliminarily applied mixture is made to contain a microwave-absorptive heat-generating substance and a hardening agent which is effective for an inorganic binder to be impregnated later, in the event that the above-mentioned heat-generating substance is also provided with the effect of the aforementioned hardening agent, there is no need to newly add the hardening agent. In addition, besides the above-mentioned components, components essentially necessitated for forming an applied film such as water, alcohol, a binder and the like are also contained in the above-mentioned mixture.

Since an inorganic bonding agent that is effective for a hardening agent contained in the above-described mixture is not contained in the mixture, the shelf life of the mixture is greatly increased.

With regard to a method for forming the applied film, various methods such as spraying, dipping, printing, etc. can be conceived, and depending upon necessity, different methods can be appropriately selected for use.

After formation of the applied film, it is dried under appropriate conditions, and thereafter it is impregnated with an inorganic bonding agent, and at this time also, the methods of spraying, dipping, printing, etc. can be appropriately selected for use.

While a hardening reaction commences within the applied film immediately after impregnation, in the event that the effect is insufficient, the effect can be improved by adding some heat. In addition, in the case where an organic component has been added into the mixture as a binder or the like, it is necessary to heat the mixture to remove it after formation of the applied film or after impregnation of the inorganic bonding agent.

With regard to the inorganic bonding agent to be used, in view of water-proofness and bonding strength a phosphate group bonding agent is preferable. Also as a hardening agent for this bonding agent, powders of various hardening agents such as $Fe_3O_4$, MgO, $Al(OH)_3$, activated alumina, etc. are conceived, but a liquid state alumina sol is also effective and it has a bonding effect in itself.

THE BEST MODE FOR CARRYING OUT THE INVENTION

Figure 1:
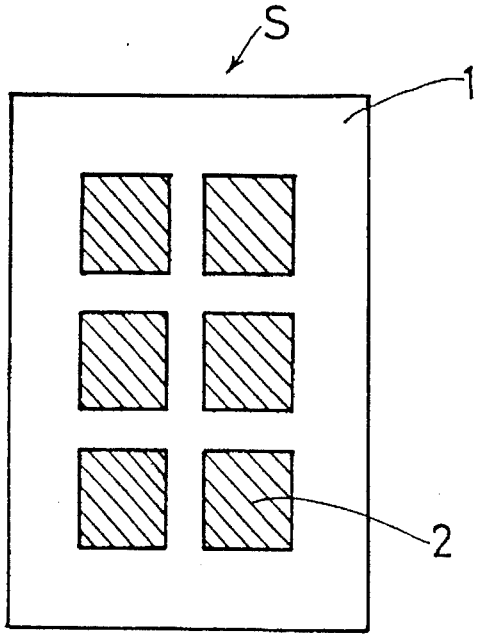
FIG. 1 is a plan view of a sheet-like heat-generating body according to the invention.

Representative prefered embodiments of the present invention will be explained with reference to the drawings.

FIGS. 1 to 6 are figures illustrating the representative prefered embodiments of the present invention.

In FIGS. 1 to 6, reference character S designates a sheet-like microwave-absorptive heat-generating body (hereinafter called "heat-generating sheet"), reference numeral 1 designates a sheet-like base material, numeral 2 designates a conductive coating film, numeral 3 designates foods or a container of foods, numeral 4 designates a box-shaped support, and numeral 5 designates a microwave-permeable inorganic coating film.

Example-1

A microwave-absorptive heat-generating sheet S was produced by carrying out printing on one surface of a sheet-like base material 1 consisting of glass fabrics with a mixture of black powder and a silica sol group inorganic binder through a screen printing process while dividing the printed area into a plurality of continuous coating film regions as shown in FIG. 1 in such manner that the size of each continuous coating film region 2 is chosen to be a 25 mm□. Each discontinuous coating film region does not contact its adjacent regions. After being printed, the discontinuous regions are baked at 200° C. for 1 Hr.

Figure 2:
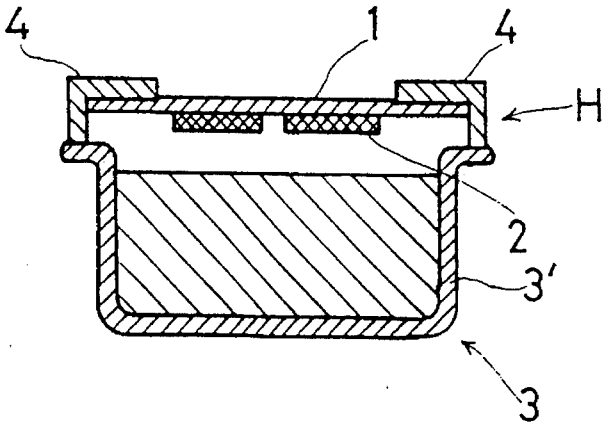
FIG. 2 is a cross-section view of a heat-generating component part formed by supporting the above-mentioned sheet-like heat-generating body from a box-shaped support.
Figure 3:
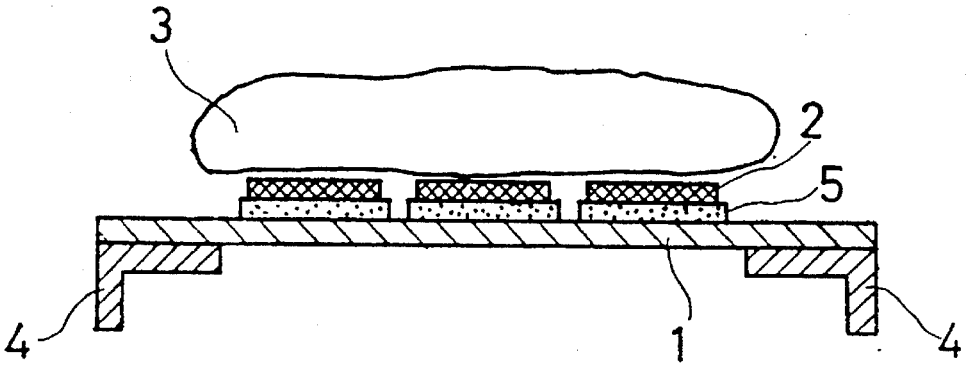
FIG. 3 is a cross-section view showing the state where the above-described heat-generating component part is placed on a container of refrigerated foods.

A heat-generating component part H was formed by sticking this sheet to a box-shaped support 4 made of a thick paper sheet into a structure shown in FIG. 2, then this component part was placed on a top surface of a container 3' of a commercially available refrigerated cheese 3, and cooking by heating for about 7 minutes was effected by means of a conventional microwave range for domestic use.

In addition, with respect to a microwave-absorptive heat-generating body in which besides the aforementioned graphite powder, $Al_2O_3$ powder was added as a filler and thereby a content of graphite was varied, also a similar test was conducted.

The test results are shown in Table-1.

TABLE 1

| Blending Proportion | | Graphite Vol. % | Thin Film (μm) | Resistance Value R (Ω) | Specific Resistance ρ (Ω/m) | Cooked Condition Scorch |
|---|---|---|---|---|---|---|
| Graphite | $Al_2O_3$ | | | | | |
| 100 | — | 70 | 150 | 30 | $4.5 \times 10^{-3}$ | X |
| | | | 70 | 75 | $5.3 \times 10^{-3}$ | X |
| | | | 20 | 335 | $6.7 \times 10^{-3}$ | ⊙ |
| 50 | 50 | 40 | 50 | 200 | $3.0 \times 10^{-2}$ | ⊙ |
| | | | 70 | 550 | $3.9 \times 10^{-2}$ | ⊙ |
| | | | 20 | 1650 | $3.3 \times 10^{-2}$ | ○ |
| 25 | 75 | 20 | 150 | $5 \times 10^4$ | 7.5 | Δ |
| | | | 70 | $1.1 \times 10^5$ | 7.7 | X |
| 10 | 90 | 9 | 150 | $2 \times 10^7$ | $3.0 \times 10^3$ | X |

As will be apparent from Table-1, resistance values falling in the range of $10^2$~$10^5$ Ω, especially in the range of $10^2$~$10^3$ Ω represent favorable results.

The content percentage in volume of graphite is inversely proportional to the specific resistance, and as the content lowers, an increase of a specific resistance is observed. It is well understood that if the content proportion decreases, then in order to obtain the appropriate resistance values, a film thickness must be considerably increased, and for a coating film having a graphite content proportion of 9%, a thickness of 1~10 m is necessitated to realize a resistance value of $10^2$~$10^3$ Ω.

Example-2

A conductive coating film having an area of divided individual coating film region varied in the range of □3 mm~□50 mm squares so as to have an equal total area of the entire coating film regions was formed on one surface of each of several glass fabrics, then they were heated by means of a conventional microwave range for domestic use, and their surface temperatures were measured by a radiation thermometer.

In this connection, at the time of heating by the microwave range, as a load 500 cc of water was simultaneously heated.

The results are shown in Table-2.

TABLE 2

| Coating Film Area | 1 min. | 2 min. |
|---|---|---|
| 3 × 3 | 80° C. | 90° C. |
| 5 × 5 | 100° C. | 130° C. |
| 7 × 7 | 215° C. | 265° C. |
| 10 × 10 | 350° C. | 355° C. |
| 20 × 20 | 385° C. | 400° C. |
| 30 × 30 | 500° C. | 505° C. |
| 50 × 50 | 550° C. | 575° C. |

It is seen that for an area of 5×5 $mm^2$ or less a heat-generating quantity is small, and as an area increases a heat-generating quantity becomes large.

Example-3

A paper napkin principally consisting of pulp was impregnated with water glass, then subjected to acid treatment, washed by water, dried and subjected to flame-proofing treatment. One surface of the prepared sheet 1 was coated with a mixture consisting of 80 parts $Al_2O_3$ powder, 20 parts pearlite, an aluminium phosphate group binder and a hardening agent to form a microwave-permeable inorganic coating film 5. The upper surface of the formed coating film 5 was coated with a mixture consisting of Kish-graphite powder and an aluminium phosphate group binder to form a conductive coating film 2. Thereby a sheet having the structure shown in FIG. 3 was produced. When commercially available refrigerated pizza pies (5 inches in diameter) 3 was placed on this sheet so as to come into contact with its upper surface and they were cooked for about 3 minutes by means of a microwave range, the crust was scorched into light brown color, also good crispy feeling was obtained, and the pizza pie was properly cooked without being excessively heated as a whole. On the other hand, no smoke nor no nasty smell was issued at all from the sheet.

Example-4

Figure 4:
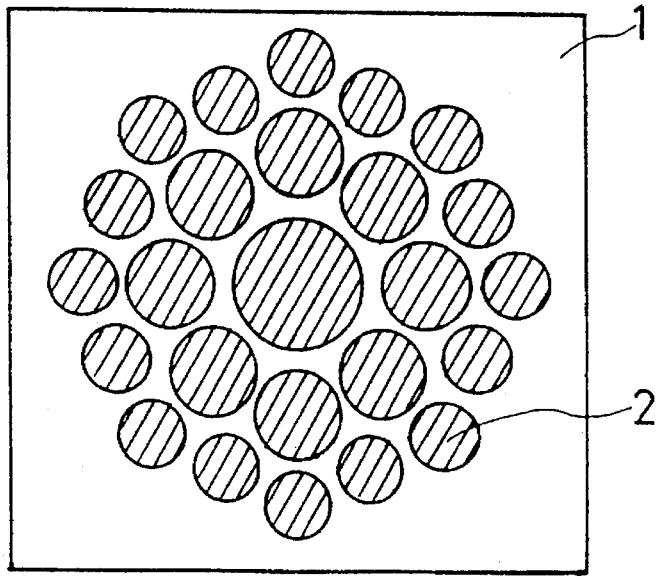
FIG. 4 is a cross-section view of a heat-generating component part making use of a sheet-like heat-generating body according to another prefered embodiment of the present invention.

A heat-generating sheet was produced by applying a mixture consisting of 30 parts graphite, 70 parts $Fe_3O_4$ and a water glass group binder onto one surface of a sheet 1 made of glass fabrics through a screen printing process so that the coating films may have a thickness of 200 μm and may have a large size at the central portion and successively reducing film sizes towards its peripheral portion as shown in FIG. 4, and after drying, immersing the sheet in 20% aqueous acetic acid to convert water glass into silica gel and form an insoluble coating film. When a commercially available pizza pie was placed on this sheet and cooking was carried out in a microwave range, the entire surface was uniformly given crispiness and presented a good taste.

Figure 5:
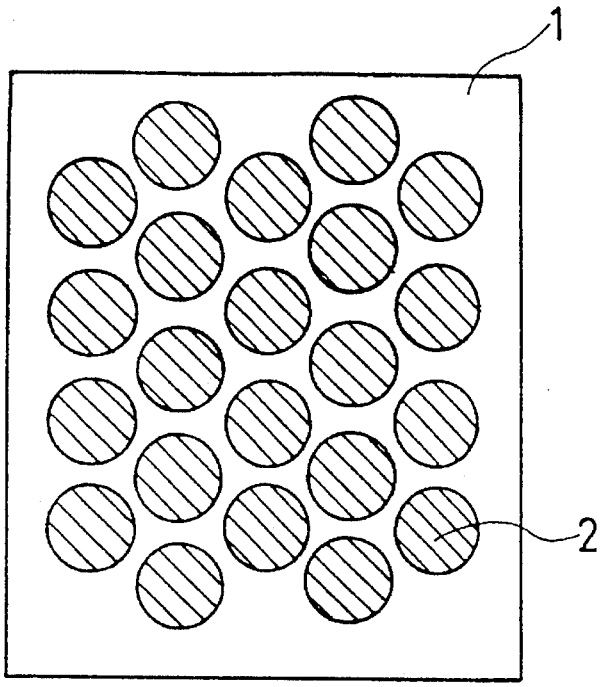
FIGS. 5 and 6 are plan views similar to FIG. 1, showing various modified embodiments of the arrangement and configuration of conductive coating films on a sheet-like base material.

When same coating films were formed over the entire surface in a similar manner as shown in FIG. 5, and a similar test was conducted, the central portion was not scorched but somewhat wet, and crispiness was only present at the peripheral portions.

Example-5

Figure 6:
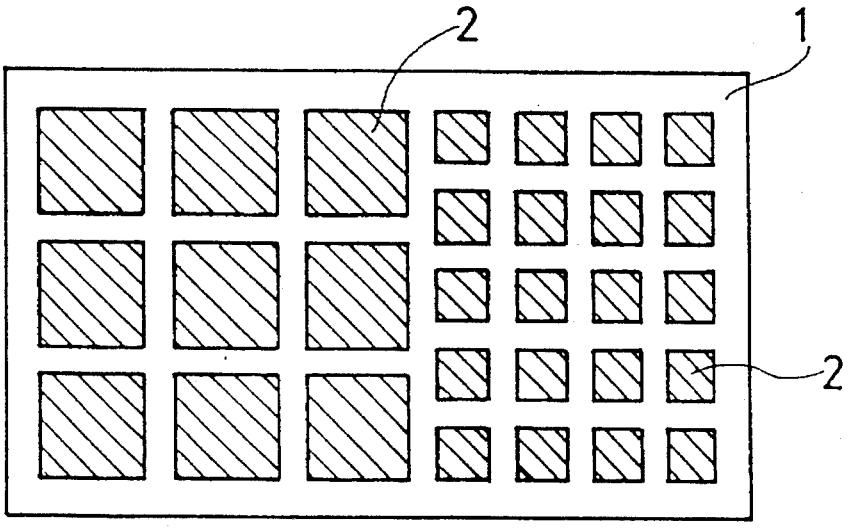

A sheet having a multiplicity of discontinuous areas of coating films thereon which were varied in size depending upon their locations as shown in FIG. 6, was produced through a process similar to that used in Example-4. Then a slice of bread was placed at the place where the coating film areas are small, while a pizza pie was placed at the place where the coating film areas are large, and they were cooked simultaneously.

Although a slice of bread is liable to be scorched as compared to a pizza pie because of its light loading, they could both be appropriately scorched to a similar extent even if they were both cooked simultaneously because the heat-generating rate of the sheet is different between the respective sections.

Besides the above-mentioned example of use, this embodiment appears to be effective upon simultaneously cooking different kinds of foods such as are used in a lunch-box or the like.

As described above, the heat-generating sheet according to the present invention is light in weight, cheap, and excellent in a heat-generating property. For its manufacturing process a procedure of printing can be used, and mass-production thereof is also easy. And so, it can be used as a disposable sheet as inserted within a package jointly with commercially available refrigerated foods or it can be integrated with a package.

Since adjustment of a heat-generating property can be achieved by controlling not only the film thickness but also both the carbon content and the film area in combination, design matched with foods can be done easily. Moreover, as it is also easy to vary the heat-generating rate depending upon location, uniform cooking and selective cooking can be carried out.

Furthermore, since it is possible to give flexibility to the sheet, the sheet can be used in a deformed configuration so as to meet the shape of foods.

Example-6

Powders of $ZrO_2$ (mean particle diameter 10 μm), ZnO (mean particle diameter 5 μm), $Fe_3O_4$ (−200 mesh), MgO (mean particle diameter 5 μm) and activated $Al_2O_3$ (mean particle diameter 50 μm) were added with appropriate amounts of water, $SiO_2$ sol (Snowtex 30: made by Nissan Chemical Industry Co., Ltd.) and $Al_2O_3$ sol (Aluminasol 200: made by Nissan Chemical Industry Co., Ltd.) as a solvent. The mixture was coated on a $ZrO_2$ plate of 50×50 $mm^2$ in a thickness of 0.5 mm, and then the plate was dried. Futhermore, these coating films were impregnated with water glass (JIS 3) and aluminium phosphate (100 L made by Tagi Chemical Co., Ltd.) by brushing, and thereafter they were dried at room temperature conditions. The obtained specimens were subjected to a boiling test for one hour, and the test results are shown in Table-3.

TABLE 3

| Powders & Virtual Volume Ratio | Solvent | Impregnated Inorganic Bonding Agent | Elution after Test |
|---|---|---|---|
| $ZrO_2$ | water | water glass | x |

TABLE 3-continued

| Powders & Virtual Volume Ratio | Solvent | Impregnated Inorganic Bonding Agent | Elution after Test |
|---|---|---|---|
| ZnO | ↑ | ↑ | o |
| $ZrO_2$:ZnO = 1:1 | ↑ | ↑ | o |
| $ZrO_2$ | ↑ | aluminium phosphate | x |
| ZnO | ↑ | ↑ | x |
| $ZrO_2$:ZnO = 1:1 | ↑ | ↑ | x |
| $Fe_3O_4$ | ↑ | ↑ | o |
| ↑ | $SiO_2$ sol | ↑ | o |
| ↑ | $Al_2O_3$ sol | ↑ | o |
| $ZrO_2$ | $SiO_2$ sol | ↑ | x |
| ↑ | $Al_2O_3$ sol | ↑ | o |
| $ZrO_2$:MgO = 1:1 | water | ↑ | o |
| $ZrO_2$:activated $Al_2O_3$ = 1:1 | ↑ | ↑ | o |

o: No Elution
X: Elution Observed

As will be obvious from Table-3, ZnO is effective as a hardening agent for water glass, but for aluminium phosphate, $Fe_3O_4$, MgO, activated alumina and $Al_2O_3$ sol are effective, and further, it is seen that these hardening agents can also give water-proofness.

Example-7

After graphite powder having a mean particle diameter of 4 μm and MgO powder having a mean particle diameter of 5 μm were mixed at a weight proportion of 35:65, an appropriate amount of water was added to the mixture, and then the mixture was sprayed on a dish of Φ200 made of cordierite to form a coating film. After the film was dried at room temperature, the above-described aluminium phosphate was impregnated into the applied coating film likewise through spraying after drying the film at room temperature, it was further dried at 200° C. for 30 minutes, and thereby a microwave-absorptive heat-generating body was obtained.

As made, the thickness of the heat-generating layer was 10 μm, and its resistance value was 100~1000 Ω. After this dish-shaped heat-generating body was subjected to a boiling test for one hour, neither elution nor change of a resistance value was observed. In addition, when this dish was heated by a microwave for 1 minute in a microwave range of 500 W and its surface temperature was measured by a radiation thermometer, the meter indicated 260° C., but neither generation of cracks nor pealing caused by thermal shocks was observed in the heat-generating layer itself.

Example-8

Graphite powder having a mean particle diameter of 4 μm and $Fe_3O_4$ powder of −200 mesh were mixed at a weight proportion of 15:85. An appropriate amount of the above-described $Al_2O_3$ sol was added, and thereby an ink for use in screen printing was prepared. After this ink was applied to a surface of glass fabrics through a screen printing process in the pattern shown in FIG. 1, it was dried at room temperature, and further the above-described aluminium phosphate was impregnated in this printed layer in a similar pattern. Thereafter, the printed layer was dried at 200° C. for 1 minute, and thereby a microwave absorptive heat-generating layer was obtained.

As made, the thickness of the heat-generating layer was 50 μm and its resistance value was 200~500 Ω. After this sheet was subjected to a boiling test for one hour, neither elution nor change of a resistance value was observed.

Furthermore, a support made of a paper sheet was provided at the peripheral portion of this heat-generating sheet, and thereby a microwave-absorptive heat-generating component part H as shown in FIG. 2 was obtained. As shown in the same figure, this component part was placed above a commercially available refrigerated cheese and microwave-heating was effected for 8 minutes in a 500 W microwave range. Then, the surface of the cheese was appropriately scorched, and its interior had a sufficiently cooked condition.

Example-9

A surface of a net made of steel having a wire diameter of 1 mm, an outer diameter of 160 mm and a mesh pitch of 15 mm was subjected to acid treatment to make it appropriately rough, and the net was dipped in a slurry consisting of −200 mesh $Fe_3O_4$ powder and $Al_2O_3$ sol. Thereafter it was dried at a room temperature, and then it was further dried at 200° C. for 1 hour, and after this net was sufficiently impregnated with the above-described aluminium phosphate by brush-painting, it was dried at a room temperature, then it was dried at 200° C. for 1 hour, and thereby a net-like microwave-absorptive heat-generating body was obtained. When this net was subjected to a boiling test for 1 hour, elution was not observed.

Still further, when a commercially available 6-inch refrigerated pizza pie was placed on this net and the net was heated by a microwave for 3 minutes in a 500 W microwave range, the pizza pie could be cooked with its crust portion scorched. Also, anomalies such as cracks, pealings and the like were not observed in the heat-generating body after cooking.

As described in detail above, by making use of the method according to the present invention, a microwave-absorptive heat-generating layer having a heat-resisting property can be obtained at a low temperature in a short period of time. Moreover, according to the present invention, the workability is excellent because the reactions of the hardening agent and the bonding agent would occur only within the applied film.

At this time, by selecting a water-absorptive porous body such as cordierite, glass fabrics or the like as a heat-resistant base material, further shortening of a drying time as well as improvements in a bonding strength between a base material and a heat-generating layer can be achieved.

Although the subject heat-generating layer is required to have water-proofness in the case where the heat-generating body comes into contact with foods because generally moisture is contained in the foods to be cooked in a microwave range, this can be overcome by selecting a water-proof inorganic bonding agent as represented by aluminium phosphate.

INDUSTRIAL APPLICABILITY

The microwave-absorptive heat-generating body according to the present invention can be utilized for externally heating and cooking foods by absorbing a microwave generated in a microwave range and generating heat at the time of microwave-range cooking.

The method for forming a heat-generating layer according to the present invention can be utilized for producing a microwave-absorptive heat-generating body as described above.

We claim:

1. A microwave-absorptive heat-generating body comprising a conductive coating film disposed on a heat resistant sheet-like base material, wherein said conductive coating film comprising:

a crystalline carbon as its principal component, a filler selected from the groups consisting of at least one of silica and alumina, and a hardened reaction product of an inorganic bonding agent comprising a phosphate bonding agent, with a hardening agent comprising $Fe_3O_4$.

2. A heat-generating body as claimed in claim 1, wherein said conductive coating film is comprised of at least 15% by volume of crystalline carbon.

3. A heat-generating body as claimed in claim 1 further comprising a microwave-permeable inorganic film layer laminated on a surface of said coating film disposed away from said sheet-like heat resistant base material.

4. A heat-generating body as claimed in claim 1 wherein the thickness of said coating film is 5 μm to 400 μm.

5. A heat-generating body as claimed in claim 1 wherein said coating film occupies a multiplicity of discontinuous regions on a surface of said heat resistant sheet-like base material, and wherein the area of each discontinuous region, respectively, is about 5×5 to 60×60 $mm^2$.

6. A heat-generating body as claimed in claim 5, wherein said areas of said discontinuous regions are dissimilar.

7. A heat-generating body as claimed in claim 1 further comprising a microwave-permeable inorganic film layer laminated between said coating film and said heat resistant sheet-like base material.

8. A method for forming a layer microwave-absorptive, heat-generating material on a surface of a heat-resistant base material comprising:

disposing a mixture, comprising crystalline carbon, as a microwave-absorptive heat-generating substance as its principal component and further containing at least one kind of hardening agent, comprising $Fe_3O_4$ as its principal component, onto a surface of said heat resistant base material to form at least one layer of said mixture on said base material, thereafter impregnating an inorganic bonding agent, comprising a phosphate group bonding agent hardenable by said hardening agent, into said mixture, and then hardening said inorganic bonding agent by reaction with said hardening agent to form said microwave absorptive, heat-generating layer.

9. A method for forming a microwave-absorptive heat-generating layer as claimed in claim 7, wherein said mixture comprises crystalline carbon, $Fe_3O_4$ and alumina sol.

10. A method as claimed in claim 7 further comprising disposing a microwave permeable inorganic film between said layer and said heat resistant base material.

11. A method as claimed in claim 7 further comprising disposing a microwave permeable inorganic film on a surface of said layer directed away from said heat resistant base material.

12. A method as claimed in claim 7 further comprising applying a plurality of layers of said heat-generating material to discontinuous regions of said surface of said heat-resistant base material.

13. A method as claimed in claim 12 comprising applying at least said plurality of layers at said discontinuous regions heat-generating regions and plurality of layers are similarly sized and shaped.

14. A method for forming a layer microwave-absorptive heat-generating material as claimed in claim 7, wherein said mixture comprises crystalline carbon, $Fe_3O_4$ and alumina sol, and wherein said inorganic bonding agent comprises a phosphate group bonding agent.

15. A method as claimed in claim 7 further comprising disposing a microwave permeable inorganic film between said layer and said heat-resistant base material.

16. A method as claimed in claim 7 further comprising disposing a microwave permeable inorganic film on a surface of said layer directed away from said heat-resistant base material.

17. A method as claimed in claim 7 further comprising applying a plurality of layers of said heat generating material to discontinuous regions of said surface of said heat-resistant base material.

18. A method as claimed in claim 17, wherein said discontinuous regions and plurality of layers are similarly sized and shaped.

* * * * *

UNITED STATES PATENT AND TRADEMARK OFFICE

CERTIFICATE OF CORRECTION

PATENT NO. : 5,466,917

DATED : November 14, 1995

INVENTOR(S) : Masaharu Matsuki et aL

It is certified that error appears in the above-indentified patent and that said Letters Patent is hereby corrected as shown below:

Title page,

[30] line 2, change "051045 U" to read as

-- 3-051045 U --.

Signed and Sealed this

Fifth Day of March, 1996

Bruce Lehman

*Attest:*

BRUCE LEHMAN

*Attesting Officer*

*Commissioner of Patents and Trademarks*